US005517177A

United States Patent [19]

Cantrall

[11] Patent Number: 5,517,177

[45] Date of Patent: May 14, 1996

[54] PORTABLE SECURITY DEVICE

[76] Inventor: Mary Cantrall, 23561 Los Adornos, Laguna Hills, Calif. 92653

[21] Appl. No.: 395,036

[22] Filed: Feb. 27, 1995

[51] Int. Cl.[6] ..... G08B 13/14

[52] U.S. Cl. ..... 340/571; 340/568; 150/131

[58] Field of Search ..... 340/571, 568; 150/134, 131, 133

[56] References Cited

U.S. PATENT DOCUMENTS

| | | | |
|---|---|---|---|
| 3,930,249 | 12/1975 | Steck | 340/571 |
| 4,090,183 | 5/1978 | Miller | 340/571 |
| 4,458,241 | 7/1984 | Frankenburg | 340/571 |
| 4,633,232 | 12/1986 | Nelson | 340/571 |
| 4,692,745 | 9/1987 | Simanowitz | 340/571 |
| 4,884,062 | 11/1989 | Lin | 340/571 |
| 4,890,094 | 12/1989 | Kopel | 340/571 |

*Primary Examiner*—Brent A. Swarthout

*Assistant Examiner*—Albert K. Wong

*Attorney, Agent, or Firm*—Gene Scott; Patent Law & Venture Group

[57] ABSTRACT

A portable alarm device comprised of an electronic circuit that, among other components, includes a power cell, a cell clip that holds the cell in position and an audio output means for emitting an audible alarm sound. The circuit is mounted in a folder with a centralized fold, thus forming two folder halves positioned in spaced apart adjacency, the folder including an interlocking means for temporarily securing the folder halves together so that the folder remains in a closed position. A tab is positioned on one folder half opposite the circuit and is designed to easily slide between the power cell and the cell clip when the folder is in the closed position, thus breaking the circuit and preventing the alarm from sounding. When the folder is placed in the closed, but not secured orientation, between or under an object of importance, the alarm will sound if the object is moved since this allows the folder halves to move apart thus withdrawing the tab and closing the circuit.

2 Claims, 3 Drawing Sheets

PORTABLE SECURITY DEVICE

BACKGROUND OF THE INVENTION

1. Field of the Invention

This invention relates generally to security devices and more particularly to a small, portable security device mounted within a folder which is designed to be closed and placed under or between fixed elements such that when one or more of the elements are moved, an alarm signal is produced as the folder opens.

2. Description of Related Art

As the crime rate in America continually rises, the use of security devices has risen accordingly. Security devices are often installed in homes, vehicles and other such property as a means to prevent theft. Unfortunately, many security devices are costly, require costly installations and are designed for use with a single property item. Therefore, to date property protecting security devices have typically been designed for use only in conjunction with large, valuable property items, and cannot feasibly be used to protect smaller, individual property items such as a purse, walkman or radio.

Small, portable security devices are often carried on an individual and utilized for personal safety. However, these devices typically require some sort of activation on the users part, such as blowing into a whistle or turning on an alarm. Obviously, such devices are also incapable of protecting unattended property items.

Thus, there is a clear need for an improved security device that can effectively be used not only for personal protection but also to protect a wide variety of different property items that are susceptible to theft or intrusion. Such a device would require no installation, and could therefore be reused to protect a wide variety of different property items. Even further, such a device would also effectively protect an infant or small child in a crib, stroller, high-chair or the like.

The present invention fulfills these needs and provides other related advantages as described in the following summary.

SUMMARY OF THE INVENTION

The present invention is a small portable security device, held within a folder, designed to emit an immediate sound signal when the folder is opened. The device is designed to serve not only as a personal security device, but also to effectively protect a wide variety of different items that may be left unattended.

The device is a one-piece unit that essentially consists of an electronic circuit mounted in a folder. The electronic circuit includes a circuit board with resistors, capacitors, an adapter, a piezo sound unit and a centralized metal clip under which rests a removable three volt lithium battery. Whenever the clip is in contact with the battery, the piezo sound unit is activated and sounds continuously.

The electronic system is mounted on the folder, which is preferably constructed of a single sheet of polyvinyl plastic. The folder is of a size small enough to conveniently store in a purse, pocket, wallet or the like. The folder material has a centralized flexure that divides it into two distinct halves which naturally flex away from one another.

The electronic unit is mounted on one half of the folder, adjacent the flexure so that the second half easily folds over it. A small trigger tab is cut into the other half of the folder and positioned so that when the two halves of the folder are folded together, the trigger tab is positioned between the metal clip and the battery forming an insulating barrier so that the alarm signal is thwarted. Thus, the trigger tab can be easily slid between the clip and the battery unit, which effectively keeps the piezo sound from activating.

Since the ends of the halves naturally flex away from one another, a locking mechanism is necessary to keep the folder in the closed position so that the trigger tab remains in position between the clip and the battery trait. The present invention employs a flap and slit configuration that is easily engaged and disengaged.

The locking flap is positioned near the end of the first folder half. The second folder half includes a complementary sized slit positioned so that when the two halves are brought together the locking flap and the slit align with one another. The flap is thus easily secured within the slit, thereby locking the folder closed and securing the trigger tab in position between the clip and the battery.

When the locking tab is disengaged from the slit, the ends of the folder automatically flex thereby opening the folder with such force that the trigger tab is automatically pulled from its position between the clip and the battery, thereby activating the alarm. Thus it is an object of the invention to provide a convenient, portable security device that allows an alarm to be readily emitted without any special actions, such as turning the device on, pulling an activation pin out of a hole, blowing a whistle, etc., that are typically associated with many standard personal security devices.

As detailed above, when the device is stored on a person, such as in a purse or pocket, the locking tab is locked in position so that when it is desired to sound the alarm the two halves can simply be manually pulled apart. However, the device can also be used to protect a purse, radio, cooler, or any other item that may potentially be left unattended, rife for theft. To protect such items, the alarm trigger tab is positioned between the battery and clip and the ends of the folder are brought into contact with one another. Instead of securing the ends together with the locking flap, the item to be guarded is simply set on top of the security device, so that the weight of the item effectively keeps the folder in the folded orientation. When the item is moved from atop the security device, the two ends of the folder automatically flex apart and disengage the trigger tab from its position between the battery and the clip which thus causes the alarm to activate and signal that the item is being removed. Thus it is an object of the invention to present a security device that can not only be used for personal security, but can also effectively be used to guard any number of items that otherwise be stolen. The potential uses of this device are nearly limitless, as the device can be used to protect virtually anything with a weight great enough to keep the folder halves together, including small infants and children. When folded the device assumes a slender or thin profile which allows the device to be positioned within cracks such as formed by a closed door, or under objects or even under a baby in a carriage without difficulty.

Further advantages and features of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the invention. In such drawings.

DETAILED DESCRIPTION OF THE PREFERRED EMBODIMENT

Figure 1:
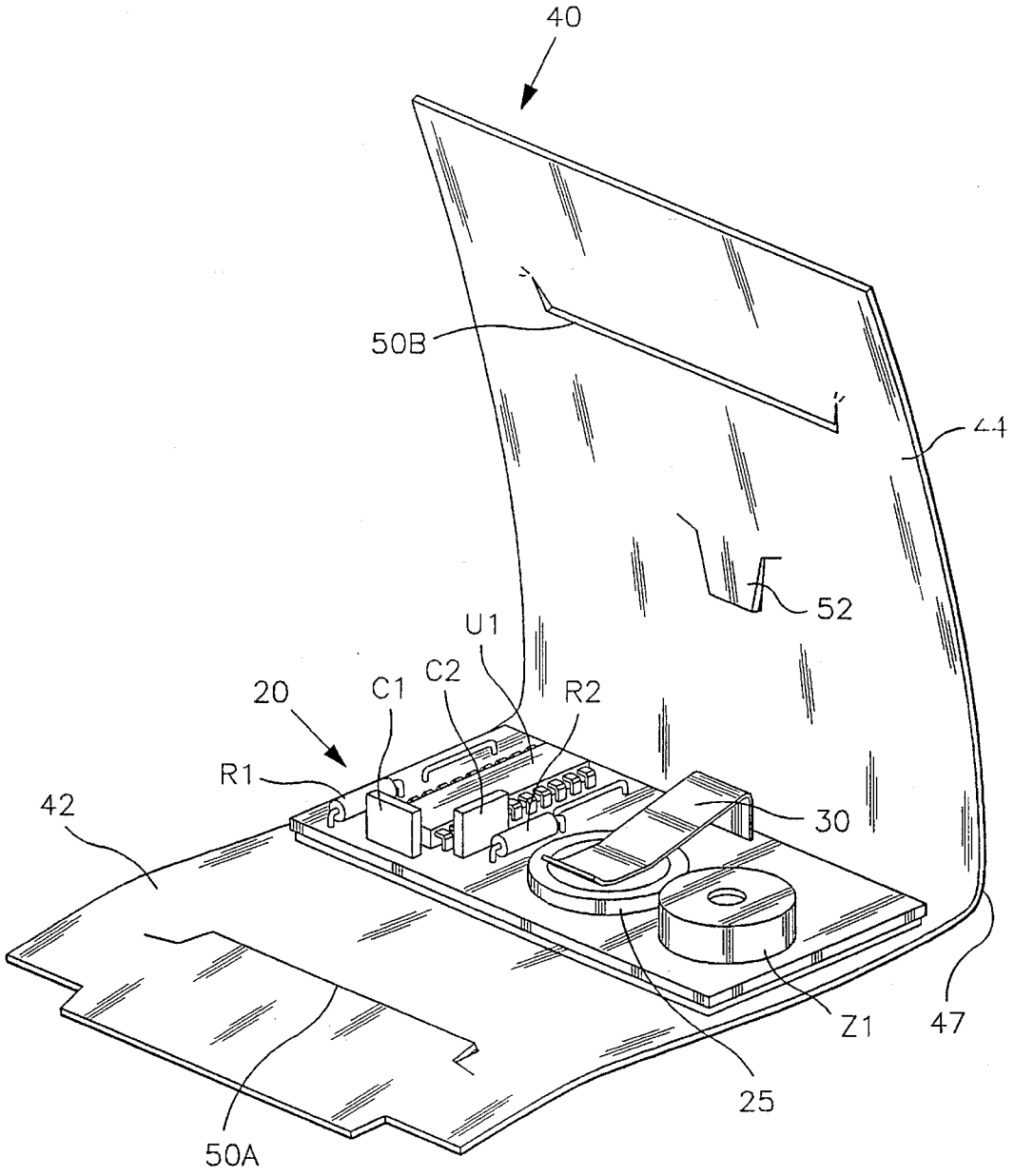
FIG. 1 is a perspective view of the preferred embodiment of the present invention, particularly showing a folder of the invention positioned in an open orientation, and further showing an electronic circuit within the folder.
Figure 2:
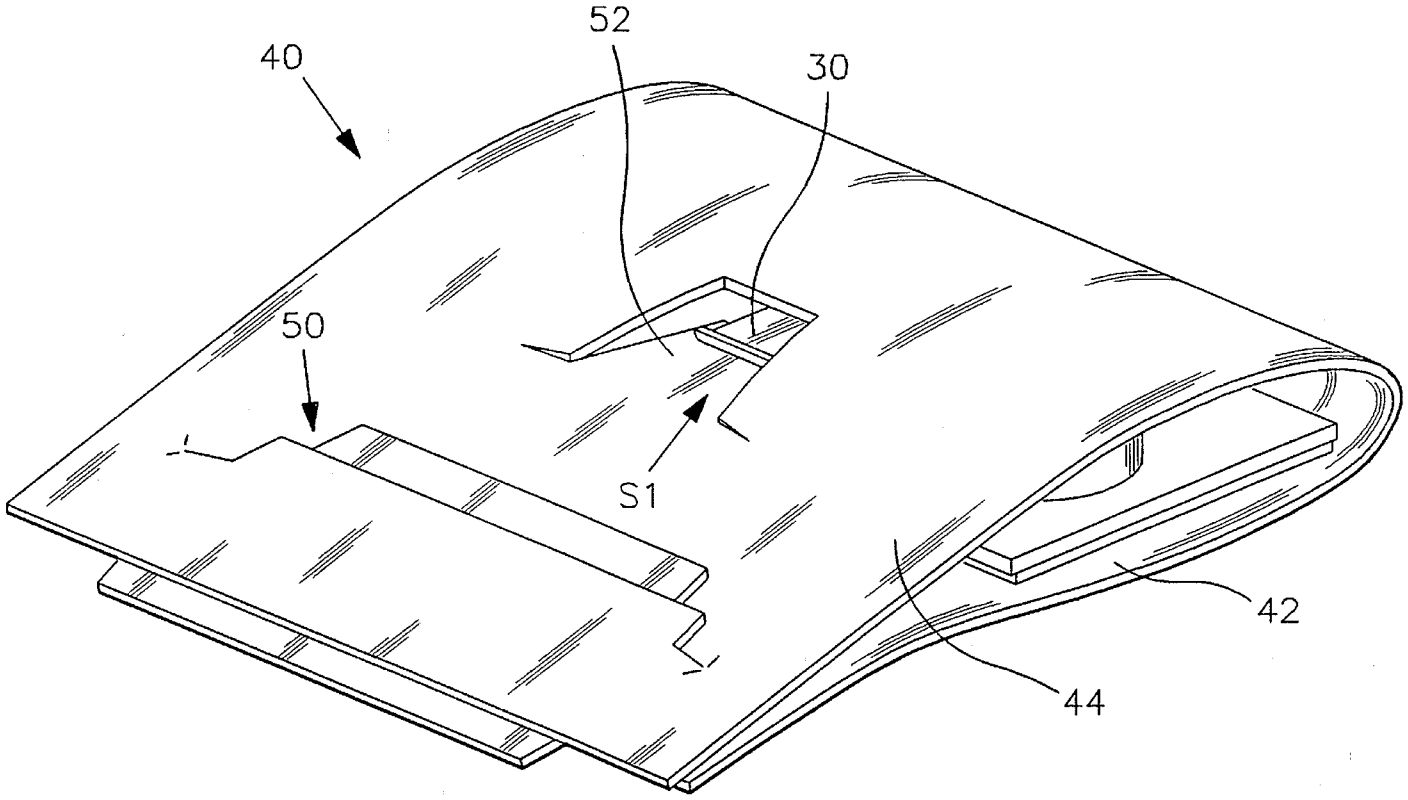
FIG. 2 is a perspective view of the invention of FIG. 1, particularly showing the folder in the closed and locked position.

FIGS. 1 and 2 show the preferred mode of the present inventive portable alarm device. The device is designed not only for personal protection, but also for protection of a wide variety of different personal property items. The device is small enough to be easily stored in a purse, pocket or wallet, or, alternately, it may be positioned under or between objects.

The portable alarm device essentially consists of an electronic circuit 20 mounted in a folder 40. The circuit 20 is comprised of several components, seen in both FIGS. 1 and 3, that are arranged and interconnected so that an audible sound is continually generated when the folder is in an open orientation as shown in FIG. 1. Among these components are a power cell 25 and a cell clip 30. The power cell 25 is preferably a replaceable, 3 volt lithium battery, and the cell clip 30 is designed to hold the power cell 25 in position. A switch S1 is made up of the power cell 25, as one electrode, the cell clip 30 as an opposing electrode, and an insulating tab which is preferably a part of the folder 40 such that when the tab 52 is positioned between the power cell 25 and the cell clip 30 the circuit 20 is open.

Figure 3:
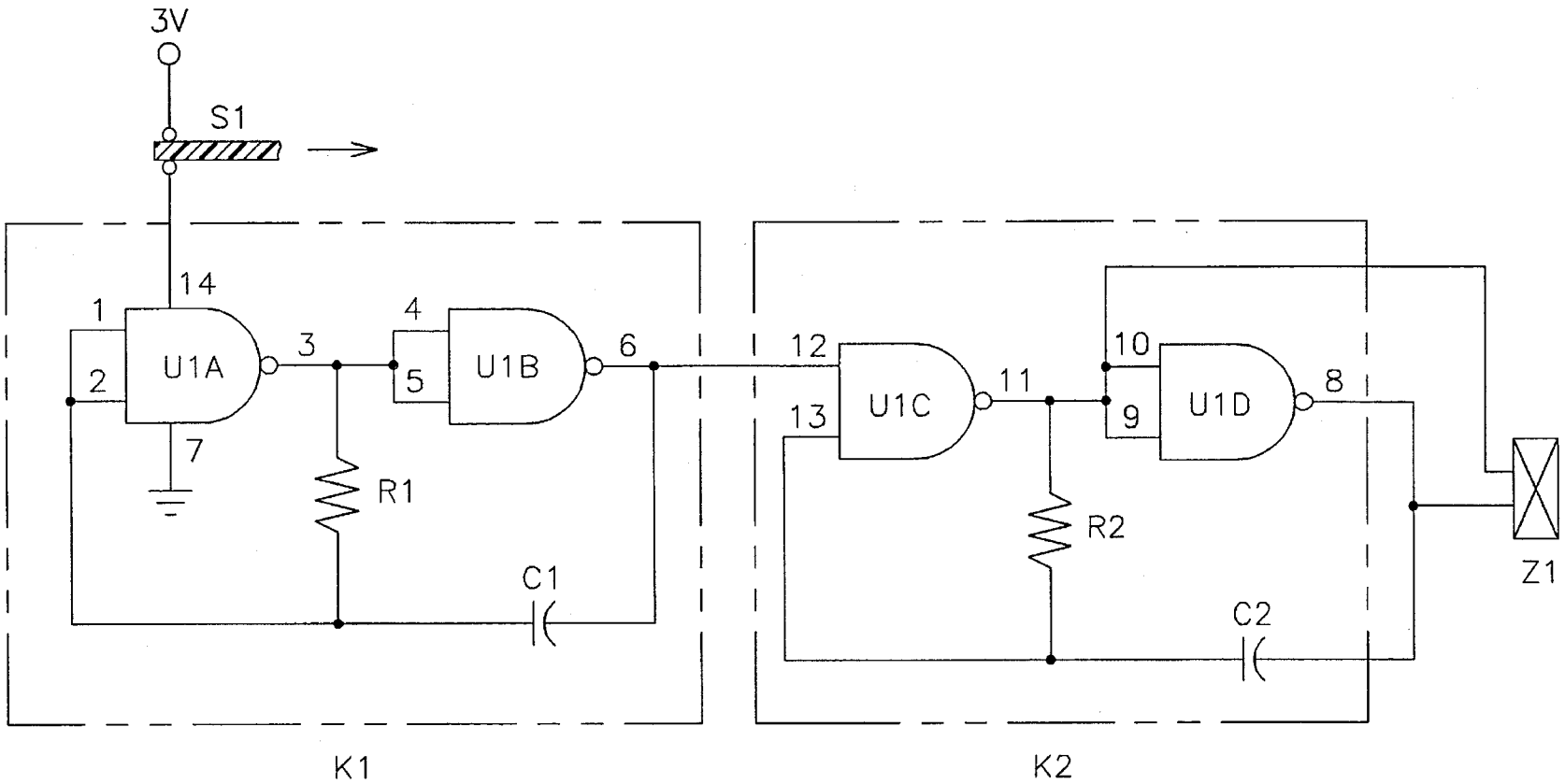
FIG. 3 is a schematic diagram of the electronic circuit of the invention.

The circuit 20 preferably includes a first oscillation means K1, which is a timing sequencer that establishes a repetition rate for an audible tone, and a second oscillation means K2 which establishes a pitch or frequency of the audible tone. These oscillation means K1 and K2 are preferably formed in part from a single quad NAND logic gate, in which, as seen in FIG. 3, U1A and U1B are included in the first oscillation means K1, and U1C and U1D are included in the second oscillation means K2. An alternate embodiment of the present invention would omit the first oscillation means K1 so that the tone generated would be constant. This is less desirable then a series of tone outputs interrupted by silences as the later is much more obtrusive. Preferably, first oscillation means K1 includes a 0.47 uf capacitor while second oscillation means K2 includes a 0.001 uf capacitor, and each oscillation means K1 and K2 includes a ⅛ Watt axial resistor, with values of 430K and 100K ohms respectively in the preferred mode. The small size of these resistors and capacitors make them ideal for the present invention, as they take up little space and allow the device to be compressed into a relatively flat state.

An audio output means Z1 is included in the electronic circuit 20, the output means Z1 producing an audible alarm sound of the tone and frequency determined by the first and second oscillation means K1 and K2. The audio output means Z1 is preferably an audio transducer, such as a piezoelectric buzzer.

The folder 40 is constructed of a resilient, electrical insulating, sheet material such as a plastic sheet stock. Such a plastic sheet stock could be selected from the group of electrically insulating materials including polypropylene, polyethyline, polyvinyl chloride, polyester, and polysulfone. A centralized fold 47 is positioned in the sheet material of the folder 40 forming or defining two folder halves 42 and 44. The folder halves 42 and 44 are resiliently biased to move into spaced apart adjacency, a condition depicted in FIG. 1.

Since the folder halves 42 and 44 naturally move apart from one another, a mutual interlocking means 50 is included so that the folder 40 can be temporarily locked together in a closed orientation, as seen in FIG. 2. The preferable embodiment of the interlocking means 50 is a flap 50A positioned in one of the folder halves 42 and a slot 50B positioned in the other of the folder halves 44, with the flap 50A and slot 50B in corresponding positions so as to allow for easy interconnection and engagement.

The electronic circuit 20 is mounted on one of the folder halves 42, preferably near the fold 47, as illustrated in FIG. 1. The other of the folder halves 44 includes the tab 52 positioned so as to correspond with the cell clip 30 of the circuit 20. Thus, when the folder 40 is in the closed orientation, the tab 52 can be easily inserted between the power cell 25 and the cell clip 30 (FIG. 2), thereby breaking the electronic circuit 20 and thwarting the output of the alarm sound. It should be noted that the interlocking means 50 and the tab 52 are preferably formed as die cuts in the folder 40.

Thus, when the portable alarm device is to be used as a personal security device, it is simply secured in the closed and locked orientation and stored in a purse, pocket or any other convenient location. When it is desired to sound the alarm, the two folder halves 42 and 44 are simply disengaged from one another, which in turn disengages the tab 52 from between the cell clip 30 and the power cell 25, thereby reconnecting the circuit 20 and immediately activating the alarm sound.

When the portable alarm device is to be used to protect a property item, the tab 52 is engaged between the cell clip 30 and the power cell 25, and the folder halves 42 and 44 are moved toward the closed orientation. However, the folder 40 is not locked in this position with the interlocking means 50, but instead the folder is held in the closed orientation by simply placing it under the object to be protected. The weight of the object keeps the folder 40 in the closed orientation and prevents the alarm from sounding. Thus, when the object is moved from its position on the alarm device, the folder halves 42 and 44 automatically move apart and disengage the tab 52 from between the power cell 25 and the cell clip 30, thereby reconnecting the circuit 20 and immediately activating the audible alarm sound.

Thus, the applications of the present invention are nearly limitless, as the device may be positioned under a baby, purse, radio or any other object with a weight great enough to keep the folder halves 42 and 44 together (approximately ½ ounce). As detailed above, the components of the circuit 20 are small and relatively flat so that when folded the device assumes a slender or thin profile. This allows the device to be positioned in confined areas, such as between two objects or within one of the cracks formed by a closed door.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A portable folder alarm comprising:

a folder including a resilient, electrically insulating, sheet material, folded such that the sheet forms a first and a second opposing half portions, the half portions being in close, spaced apart adjacency;

an electronic circuit in the first half portion including a power cell held within a cell clip interconnected to an audio output means through an oscillation means thereby establishing an audible tone;

a tab, cutout from the second half portion, the tab positioned for inserting between the power cell and the cell clip to break the electronic circuit and to disable the audio output means when the folder half portions are in said adjacency, the folder resiliently self biased so as to draw the half portions apart and away from said adjacency, and to thereby disengage the tab from between the power cell and the cell clip when the folder half portions are not in said adjacency; and means, when engaged, for mutually interlocking the folder half portions when the half portions are positioned in said adjacency.

2. The device of claim 1 wherein the interlocking means is a slot in one of the folder halves and a locking flap in the other of the folder halves, the slot and the locking flap being located in the corresponding positions for mutual interconnection and engagement when the folder half portions are in said adjacency.

* * * * *